United States Patent [19]

Takagi

[11] Patent Number: 4,576,106

[45] Date of Patent: Mar. 18, 1986

[54] MARKER ROPE

[75] Inventor: Mitsuo Takagi, Takamatsu, Japan

[73] Assignee: Takagi Kogyo Co., Ltd., Kagawa, Japan

[21] Appl. No.: 592,340

[22] Filed: Mar. 21, 1984

[30] Foreign Application Priority Data

Jan. 30, 1984 [JP] Japan ..... 59-12594[U]

[51] Int. Cl.[4] ..... G08B 7/00; E04H 17/00; E01F 9/00

[52] U.S. Cl. ..... 116/63 R; 116/67 R; 256/1; 340/114 R; 362/86; 362/250; 404/12; D10/116

[58] Field of Search ..... 116/2–4, 116/22 R, 63 R, 67 R, 202, 209, DIG. 33; 40/612; 340/114 R, 114 B, 815.22; 362/86, 250, 252, 800, 104; 256/1, 23; D10/104, 106, 114, 119, 120; D25/25; 404/9, 12–16; 206/573, 328

[56] References Cited

U.S. PATENT DOCUMENTS

| | | | |
|---|---|---|---|
| 2,997,573 | 8/1961 | Nyborg | 362/267 |
| 3,077,138 | 2/1963 | Vaughn, Jr. et al. | 362/86 |
| 3,969,720 | 7/1976 | Nishino | 340/326 |
| 4,271,458 | 6/1981 | George, Jr. | 362/806 |
| 4,439,818 | 3/1984 | Scheib | 362/250 |

FOREIGN PATENT DOCUMENTS

| | | | |
|---|---|---|---|
| 618196 | 2/1961 | Italy | 116/63 P |
| 26287 | of 1908 | United Kingdom | 362/250 |

*Primary Examiner*—Steven L. Stephan
*Assistant Examiner*—W. Morris Worth
*Attorney, Agent, or Firm*—Wenderoth, Lind & Ponack

[57] ABSTRACT

A marker rope to be stretched around a danger zone, such as a site of road repairs to warn trespassers off, has a plurality of cords. Each cord has a plug end and a socket end so as to be connected to each other and is provided with a plurality of luminous bodies and a sound producing unit which are sheathed in a water-tight manner in a colored transparent protecting tube.

7 Claims, 4 Drawing Figures

MARKER ROPE

BACKGROUND OF THE INVENTION

The present invention relates to a marker rope to be stretched around a danger zone such as a site of road repairs to warn trespassers off.

OBJECT AND SUMMARY OF THE INVENTION

It is an object of the present invention to provide a marker rope, the color of which, together with the conspicuous color of protecting tubes and the sound of sound producing means included therein, serves as a warning of danger during the daytime, while the sound producing means and on-and-off lights accommodated in the protecting tubes serve for that purpose during the nighttime.

With this object in view and as will become apparent from the following detailed description, the present invention will be more clearly understood in connection with the accompanying drawings.

DETAILED DESCRIPTION OF THE PREFERRED EMBODIMENT

Figure 1:
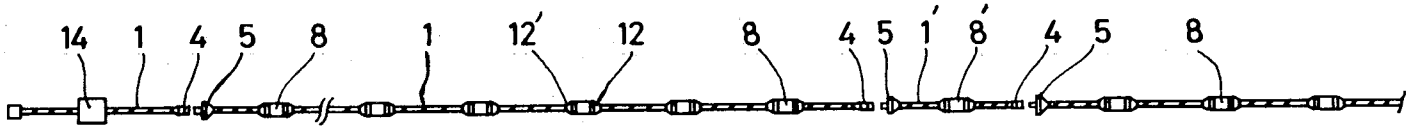
FIG. 1 is a plan view of the marker rope according to the present invention.

Referring now to the drawings, a marker rope in accordance with the present invention includes a combination of cords 1 provided with luminous bodies and cords 1' provided with a sounding body. Each of the cords 1 and 1' comprises a covering 2 made of colored rubber, and a plurality of electric wires 3 axially extending therethrough. A plug 4 is attached to one end of each cord 1 and a socket 5 to the other end thereof.

Figure 2:
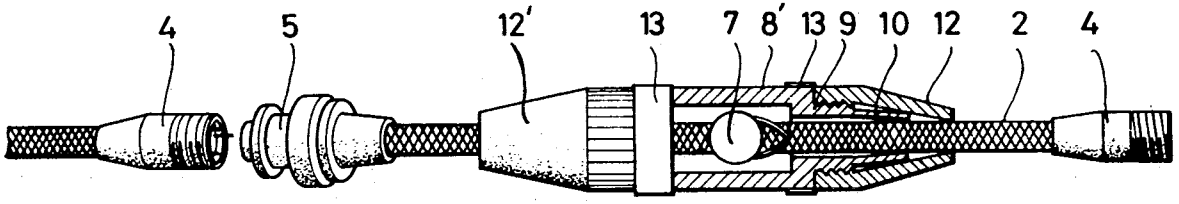
FIGS. 2 and 3 are sectional views of a part thereof.
Figure 3:
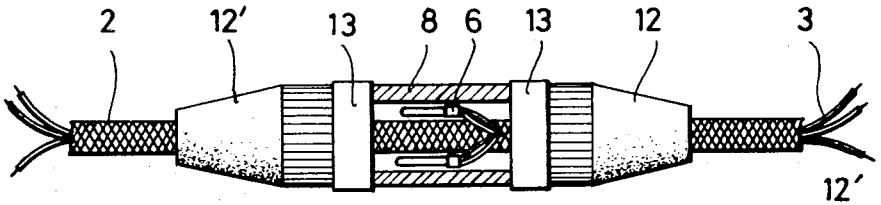
Figure 4:
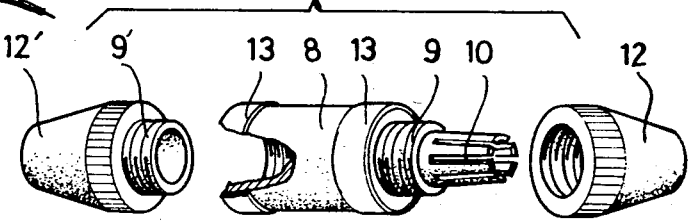
FIG. 4 is a perspective view of the slitted portion of a protecting tube.

As shown in FIG. 3, a plurality of luminous bodies 6 are connected to the electric wires 3 of each cord 1 and are disposed on the external surface of the covering 2. Miniature electric bulbs or fluorescent lights may be used as the luminous bodies 6. As shown in FIG. 2, a sound producing unit 7 is connected to the electric wires 3 of the cord 1' and disposed outside of the covering 2. The luminous bodies 6 and the sound producing unit 7 are sheathed in colored transparent protecting tubes 8 or 8'. Each tube 8 or 8' is provided with male threads 9 and toe portion 10 at one end. A plurality of slits are axially provided in the toe portion 10.

A tapered tube 12 is adapted to be screwed onto the male threads 9 on the protecting tube 8. The male threads 9' on another tapered tube 12' is adapted to be screwed into the other end of the protecting tube 8. The warning effect can be enhanced by reflective tapes 13 wound around each end of protecting tubes 8 and 8'.

A switch 14 provided in one end of the marker rope serves to automatically turn the luminous bodies 6 and the sound producing unit 7 on and off at regular time intervals.

In operation, the tapered tubes 12 and 12' are screwed onto and into each protecting tube 8, respectively, and tightened. This tightening has the following two effects. Firstly, the diameter of the slitted toe portion 10 is reduced to allow it to tightly grasp the cord 1 or 1'. Secondly, the protecting tube 8 is sealed so as to preclude the possibility of leakage of rainwater therein.

While a preferred embodiment of the present invention has been disclosed, it is to be understood that it has been described by way of example only, various other modifications being obvious.

I claim:

1. A marker rope which serves as a warning of danger and which is adapted to be stretched around a danger zone, comprising:

a plurality of first cords, each having a plurality of electric wires;

a plurality of luminous bodies, each connected to and spaced along the plurality of the electric wires for the first cords;

a plurality of second cords, each also having a plurality of electric wires;

a plurality of warning-sound producing units, each connected to and spaced along the plurality of the electric wires for the second cords;

means, wrapped around the plurality of electric wires for both the first and second cords, for covering both pluralities of electric wires;

each of the plurality of luminous bodies and each of the plurality of warning-sound producing units being disposed outside of the covering means;

a plurality of protective tube means, aligned coaxially with the pluralities of the first and second cords outside of the covering means, for surrounding the plurality of luminous bodies and the plurality of warning-sound producing units; and a plurality of tapered tube means, arranged coaxially on opposite ends of each one of the plurality of protective tube means, for sealing the protective tube means against leakage of rainwater coming into contact with the luminous bodies and the warning-sound producing units.

2. The marker rope, according to claim 1, further comprising:

a plug attached at one end of each of the pluralities of the first and second cords; and a socket attached at an opposite end of each of the pluralities of the first and second cords.

3. The marker rope, according to claim 1, further comprising:

reflective tape wrapped around a portion of each of the plurality of protective tube means.

4. The marker rope, according to claim 1, wherein:

said covering means is made of colored rubber.

5. The marker rope, according to claim 1, further comprising:

switch means, provided in electrical communication with at least one of the pluralities of first and second cords, for turning on and off automatically the plurality of luminous bodies and the plurality of warning-sound producing units at regular time intervals.

6. The marker rope, according to claim 1, further comprising:

toe means, attached coaxially on at least one end of each one of the plurality of protective tube means, said toe means having a plurality of slots which permit surrounding and gripping of the covering means by said toe means.

7. The marker rope, according to claim 6, further comprising:

external thread means, provided on said at least one end of said protective tube means, for engaging with an internally threaded portion of the tapered tube means so that the toe means grips the covering means when said internally threaded portion of said tapered tube means engages with the external thread means.

* * * * *